US006742426B2

(12) United States Patent
Cote et al.

(10) Patent No.: US 6,742,426 B2
(45) Date of Patent: Jun. 1, 2004

(54) PRECISION CUTTER FOR ELASTOMERIC CABLE

(75) Inventors: Douglas E. Cote, Homer, NY (US); Che-yu Li, Roslyn, NY (US)

(73) Assignee: High Connection Density, Inc., Sunnyvale, CA (US)

( * ) Notice: Subject to any disclaimer, the term of this patent is extended or adjusted under 35 U.S.C. 154(b) by 0 days.

(21) Appl. No.: 09/872,321

(22) Filed: Jun. 1, 2001

(65) Prior Publication Data

US 2002/0178881 A1 Dec. 5, 2002

(51) Int. Cl.[7] ..... B26D 5/20

(52) U.S. Cl. ..... 83/282; 83/385; 83/694; 83/950

(58) Field of Search ..... 83/282, 262, 268, 83/257, 206, 694, 380, 383, 385, 950

(56) References Cited

U.S. PATENT DOCUMENTS

| | | | | | |
|---|---|---|---|---|---|
| 2,826,251 | A | * | 3/1958 | Hopkins | 83/282 |
| 3,648,556 | A | * | 3/1972 | Hamilton et al. | 83/262 |
| 3,776,079 | A | | 12/1973 | Steinberg et al. | 83/225 |
| 3,793,919 | A | * | 2/1974 | Lefebvre | 83/694 |
| 3,921,874 | A | | 11/1975 | Spain | 225/4 |
| 4,003,773 | A | | 1/1977 | Grable | 156/155 |
| 4,026,017 | A | | 5/1977 | Arnold | 30/90.6 |
| 4,077,118 | A | | 3/1978 | McKeever | 29/748 |
| 4,090,425 | A | * | 5/1978 | Platt | 72/132 |
| 4,249,441 | A | | 2/1981 | Sturtz | 83/347 |
| 4,406,196 | A | | 9/1983 | Roncato et al. | 83/117 |
| 4,476,754 | A | * | 10/1984 | Ducret | 83/282 |
| 4,797,179 | A | | 1/1989 | Watson et al. | 156/647 |
| 4,806,298 | A | | 2/1989 | Wilkinson et al. | 264/115 |
| 4,986,155 | A | | 1/1991 | Hays, Jr. | 83/222 |
| 5,020,404 | A | | 6/1991 | Hoeh | 83/298 |
| 5,226,336 | A | | 7/1993 | Coates | 83/170 |
| 5,585,138 | A | | 12/1996 | Inasaka | 427/125 |
| 5,660,073 | A | * | 8/1997 | McBroom et al. | 83/694 |
| 6,014,919 | A | * | 1/2000 | Jacobsen et al. | 83/282 |
| 6,027,346 | A | | 2/2000 | Sinsheimer et al. | 439/66 |
| 6,435,068 | B1 | * | 8/2002 | Stuckart | 83/694 |
| 6,584,823 | B2 | * | 7/2003 | Hresc et al. | 72/129 |
| 2002/0073815 | A1 | * | 6/2002 | Dean et al. | 83/24 |

FOREIGN PATENT DOCUMENTS

| | | |
|---|---|---|
| DE | 19801544 | 7/1999 |

* cited by examiner

*Primary Examiner*—Stephen Choi
(74) *Attorney, Agent, or Firm*—Brown & Michaels, PC

(57) ABSTRACT

A method for cutting an elastomer cable into ultra-precise, defect-free segments of consistent length, and an apparatus to perform the same. The invented apparatus comprises cable advancement, cable clamping and cable shearing systems. The cable advancement system comprises rollers with a groove substantially matching the diameter of the cable. The cable clamping system comprises a pair of dies with a preferably conical feed hole and a clamping hole substantially matching the diameter of the cable. The cable shearing system comprises a preferably extra keen coated cryo treated movable razor blade that is held at an adjustable angle against the face of the clamping dies and slides in a linear path at a low sawing angle. In one embodiment, a second razor blade for nicking the cable prior to shearing—on substantially the opposite side of the cable from where shearing begins—is used to prevent tears in cable slices. The invented apparatus can be manually operated, or it can be motorized.

8 Claims, 6 Drawing Sheets

PRECISION CUTTER FOR ELASTOMERIC CABLE

BACKGROUND OF THE INVENTION

1. Field of the Invention

The invention pertains to the field of cutting. More particularly, the invention pertains to a method and apparatus for precision cutting of filamentary substances to predetermined lengths.

2. Description of Related Art

Electronic devices such as printed wiring boards are often connected so that data can pass from one device to the other. As the trend toward electronic component miniaturization continues, the volume of such data continues to increase. This requires that the contacts between the electronic devices be of a high density.

Often, electronic components are interconnected by a system of contacts referred to as a Land Grid Array (LGA), which typically contains electrical interposers to provide an effective connection medium. LGA interposers, in turn, contain inserted conductive "buttons." The manufacturing of such buttons entails defect free cutting of a conductive elastomer cable medium into ultra-precise segments. The elastomer cable consists of a number of thin metallic filamentary materials that conduct electricity—i.e., wires, embedded in an elastomeric body, that is, a body made out of an elastic material resembling rubber. The ultra-precise segments of the cable become buttons once they are inserted into the LGA carrier.

The manufacture of ultra-precise segment buttons such as those described above poses unique problems, as the cable-slices must be precisely and cleanly cut, of consistent length, and possessing of no surface defects, such as distorted conductors or torn elastomer. Among the chief challenges are ensuring that the elastomer cable is not damaged during cutting—which would result in defects that would raise the contacts resistance beyond that of industrial standards—and ensuring that the buttons are of extremely short and consistent length. In sum, there is a need to slice a thin cable into ultra precise slices of consistent length with no defects in the resulting segments.

In the prior art, several techniques were developed to perform this high-precision cutting job. These techniques include laser, water jet, X-ACTO knife, scissors, wire cutters and razor blade methods. The water jet and laser approaches were expensive, while the other methods resulted in cuts of poor quality. Accordingly, there remains a need in the industry for an inexpensive, yet highly effective, method of slicing elastomeric cable into ultra-precise, undamaged segments of consistent length.

SUMMARY OF THE INVENTION

The invention discloses a method of cutting an elastomer cable into ultra-precise segments of consistent length with a high level of confidence that the top and bottom of the segments will be smooth and otherwise free of defects. The invention also discloses an apparatus, called a "cutter," for performing such cuts. The cutter is an elastomer cable slicer with adjustable feed, clamping die and sawing razor action. The cutter uses one or more single-edge razor blade(s) for sawing purposes; such blade(s) transverse the surface of a die that holds the elastomer cable. A clamp holds the cable in place during cutting and a mechanical feed mechanism advances the cable to provide accurate and adjustable feed lengths. The cutter of the present invention can be reliably integrated into a high throughput rate manufacturing process.

DETAILED DESCRIPTION OF THE INVENTION

Figure 1:
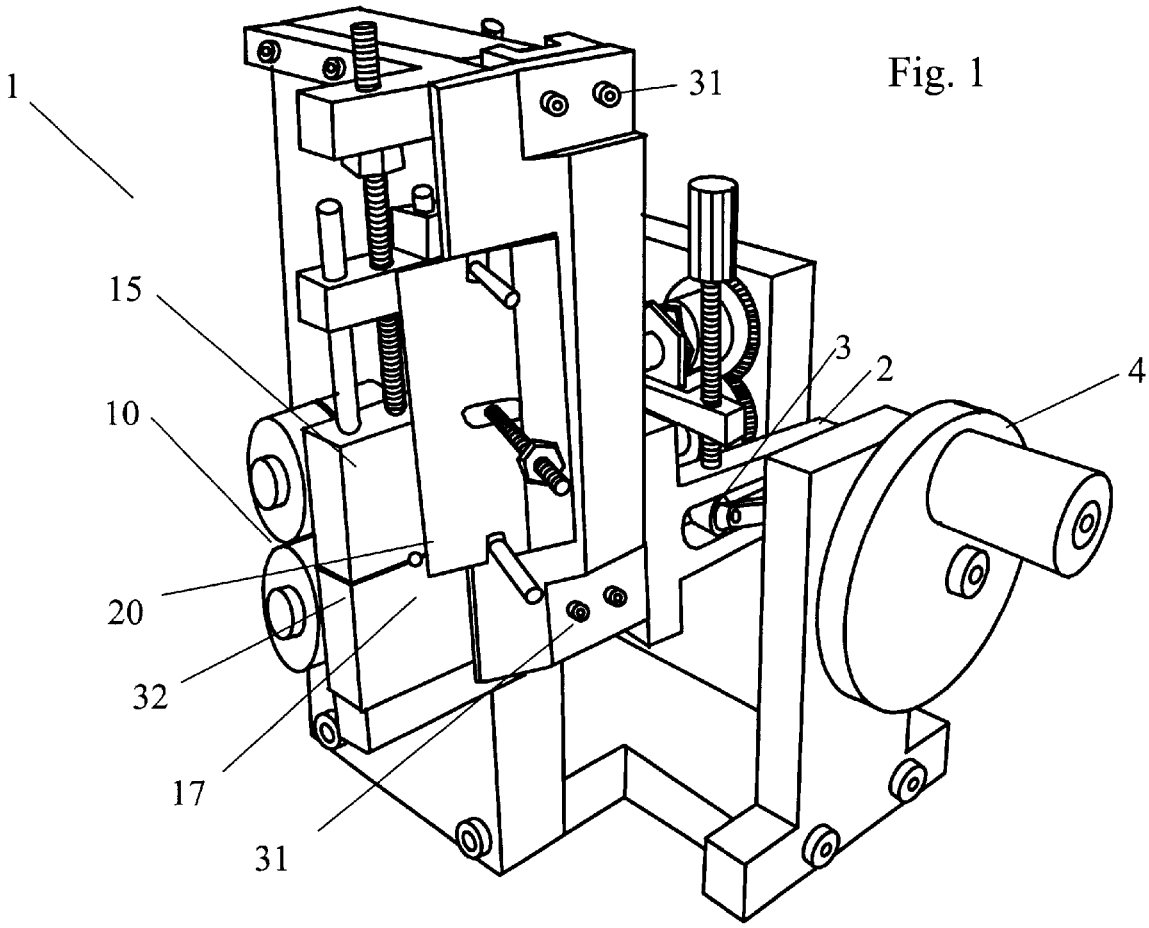
FIG. 1 shows a cutter according to the current invention.

To assist in a better understanding of the present invention, a specific embodiment of the invention will now be described in detail. Although such is the preferred embodiment, it is to be understood that the invention can take other embodiments. This detailed description of the invention will include reference to FIGS. 1 through 6. The same reference numerals will be used to indicate the same parts and locations in all the figures unless otherwise indicated. It will be apparent to one skilled in the art that the present invention may be practiced without some of the specific details described herein. In other instances, well-known structures and devices are shown in block diagram form.

A. Cutter Design

Referring to FIG. 1, the cutter of the present invention (1) includes an accurate cable-advancement system (10) integrated with a precision clamping die, comprising a lower die (32) and an upper die (33), to restrict movement or shifting of the elastomer cable or fiber during cutting. The cutter additionally includes a shearing system (20). Following advancement and clamping, the shearing mechanism cleanly cuts the protruding portion of the elastomer cable from the face (17) of the clamping die (32, 33). Thus, a cable advancement system (10), a cable clamping system (15), and a cable cutting system (20)—together with a means of operating the same, comprise the invented cutter (1) and are described in detail herein.

1) Cable Advancement System

Figure 2:
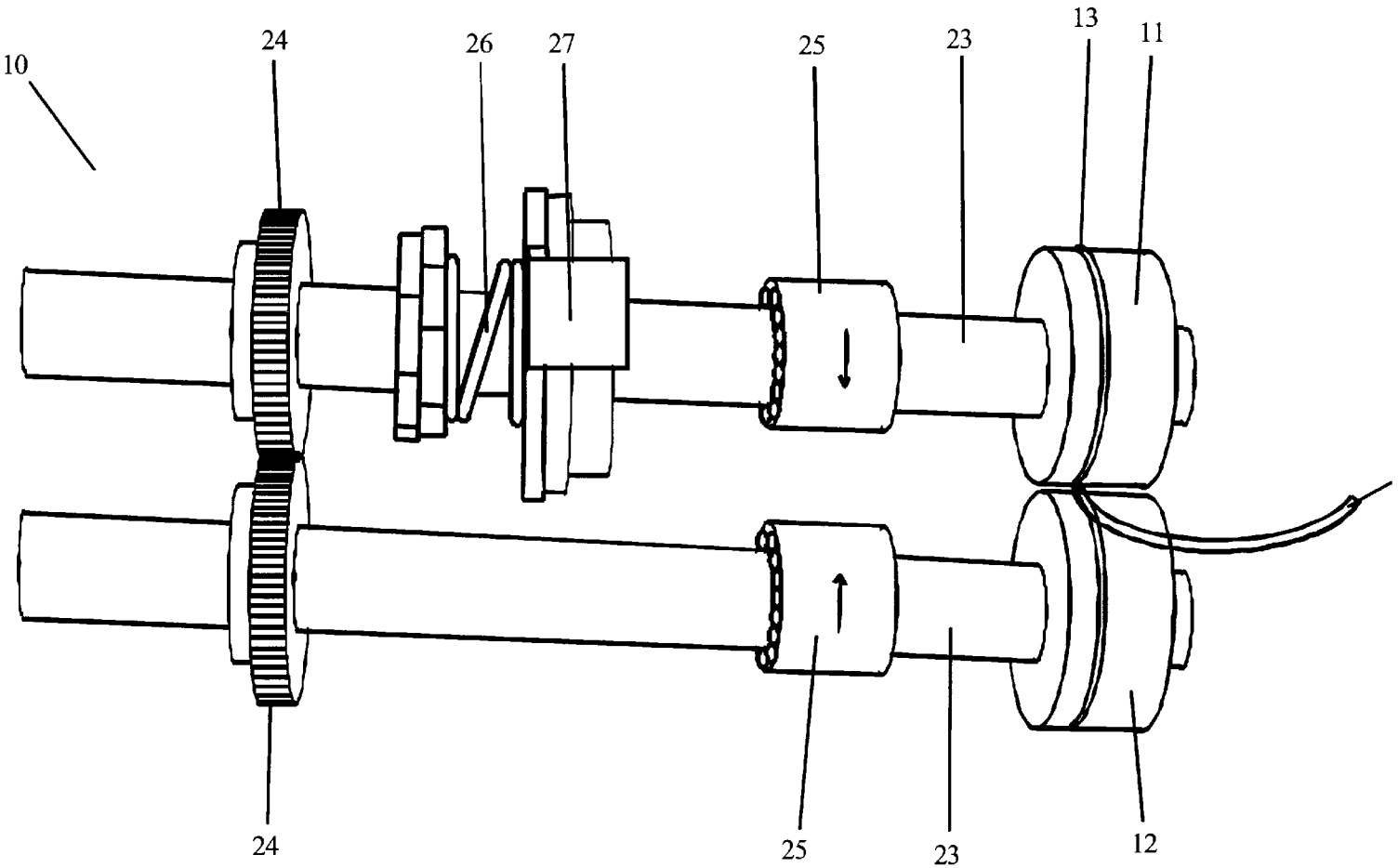
FIG. 2 shows a cable feed system according to the current invention.

Referring to FIG. 2, the cable advancement system (10) consists of cable feed rollers (11, 12) having a groove (13) with a diameter substantially equal to that of the cable to be cut (14). The feed rollers (11, 12) feed the cable (14) into a clamping die (as shown in 15 of FIG. 1). Shafts (23) tied together by a pair of zero backlash gears (24) drive the rollers (11, 12). These shafts (23) are turned through use of a feed clutch arm (27). A roller clutch (25) on one or both shafts (23) keeps the drive mechanism feeding cable in only one direction. A feed clutch (26) on one shaft (23) advances the rollers (11, 12) during cable feed and slips during feed clutch arm (27) return motion. The motion of a slotted actuator arm (FIGS. 1, 2) off the hand crank (FIGS. 1, 4) actuates a feed clutch arm (27) attached to the clutch (26). The feed clutch arm (27) preferably contains two adjustments, one for motion timing and the other for cut length. In a motorized embodiment of the invented apparatus, a gear reduction and stepper motor drive is utilized to turn the shaft the required angle so as to advance the elastomer cable the required distance.

2) Cable Clamping System

Figure 3:
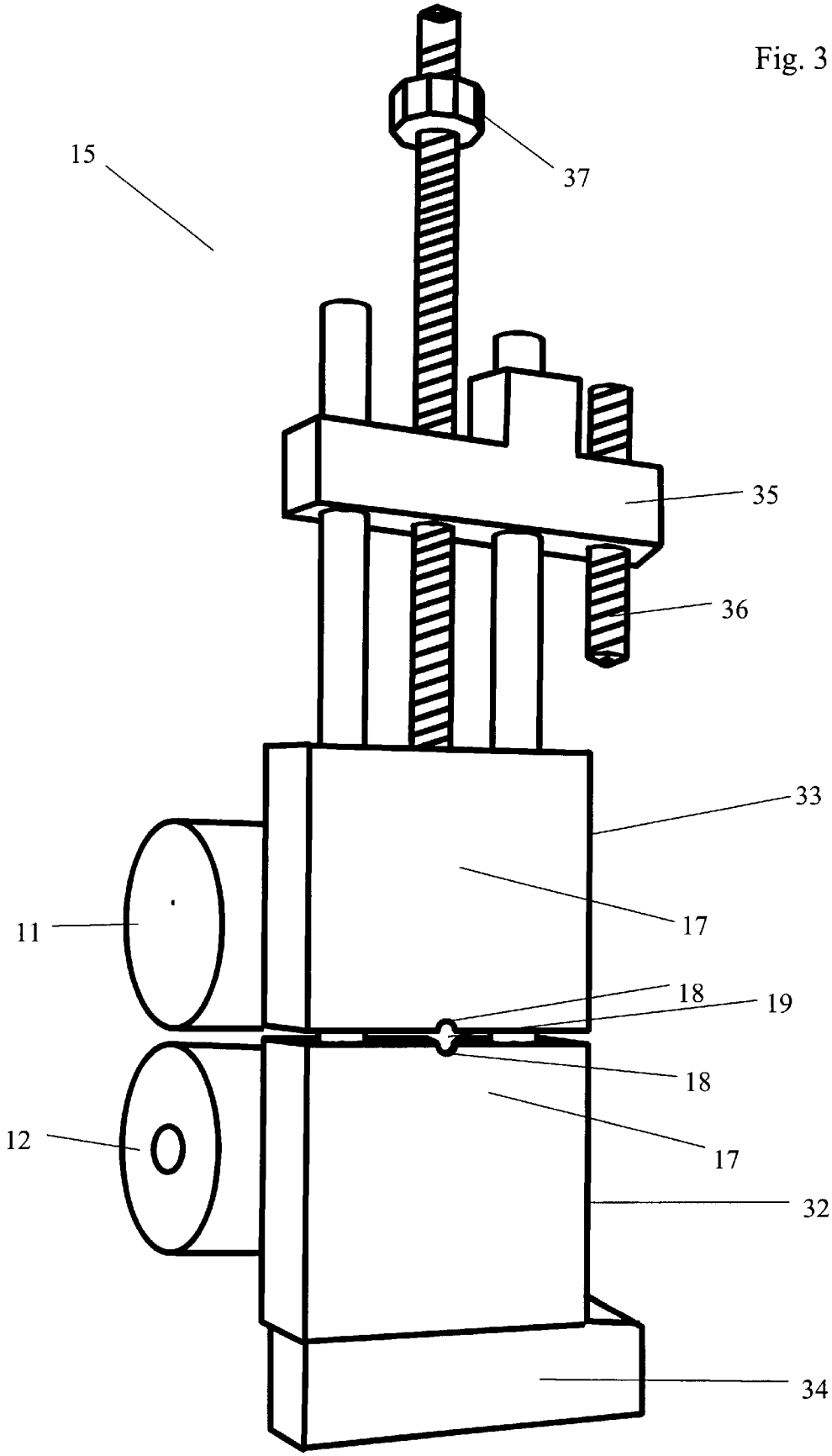
FIG. 3 shows a cable clamping system according to the current invention.

Referring to FIG. 3, the cable clamping system (15) consists of a pair of hardened steel dies (32, 33) with a portion cut out (18) forming a clamping hole (19) between the two halves. The diameter of the clamping hole (19) is substantially equal to that of the cable it clamps. Preferably, the length of the clamping hole (19) having such diameter does not run the entire length of the dies (32, 33), but rather, a portion of the clamping hole has a larger diameter to allow for easier feeding of the cable through the clamping system (15).

Figure 4:
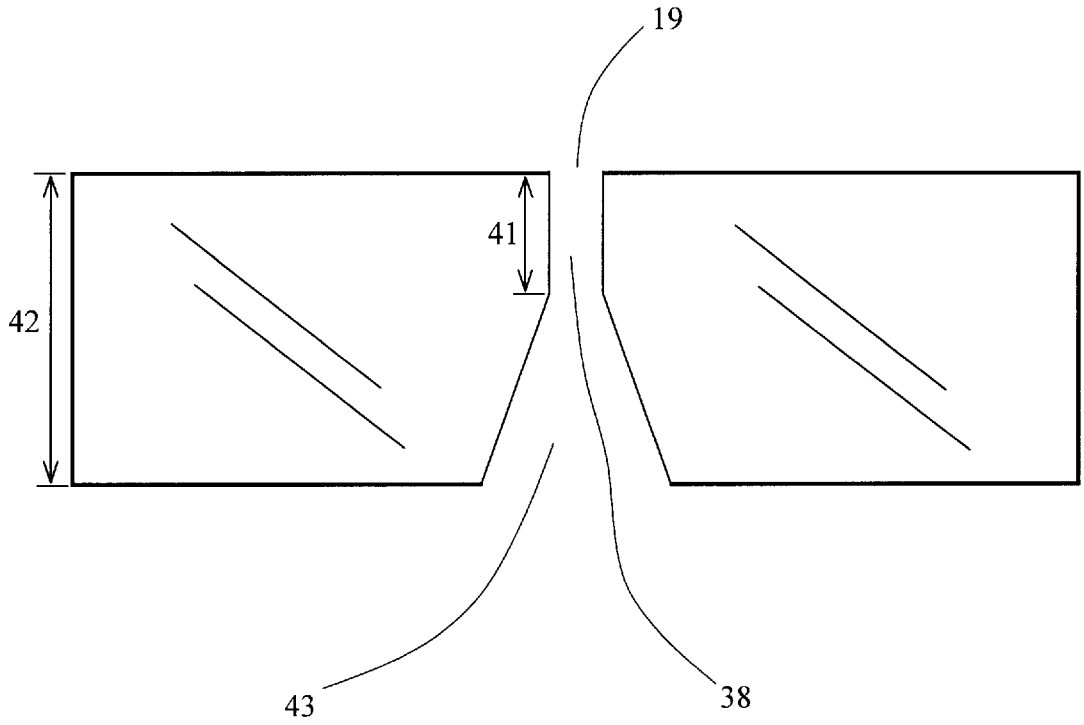
FIG. 4 shows a cross section of a clamping die, with conical feeder portion, according to the current invention.

Referring to FIG. 4, a horizontal cross-section of the clamping die is shown at the point of the clamping hole (19). The clamping hole (19) has a clamping die entryway, or "feeding portion"(43), which has a diameter greater than that of the cable. This portion is preferably conical to guide the cable into the clamping area (38) of the die as the cable proceeds from the rollers. The clamping hole (19) also has a clamping portion (38) whose diameter is substantially equal to the diameter of the cable to be clamped. Preferably, the length (41) of the clamping portion (38) is approximately two percent of the length (42) of the die, while the other approximately 98% makes up the feeding portion (43). (In FIG. 4, the percentage length (41) of the clamping portion (38) is higher than two percent for purposes of illustration.)

Referring again to FIG. 3, the two clamping dies (32, 33) sit in a fixture (34) that holds the lower die (32) in place and allows the upper die (33) to rise slightly, thus facilitating the cable to advance through the hole (19) between the dies. A setscrew adjustment (36) on the die lifter arm (35) actuates the clamping mechanism with the motion of the slotted actuator arm (FIGS. 1, 2) off the hand crank (FIGS. 1, 4). The clamping mechanism (15) preferably has two adjustments, one (36) for motion timing and another (37) for die opening distance.

3) Cable Cutting System

Figure 5B:
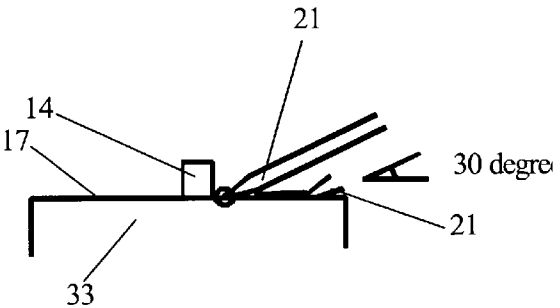
FIG. 5B is a plan view of the cable cutting system of the current invention.
Figure 5A:
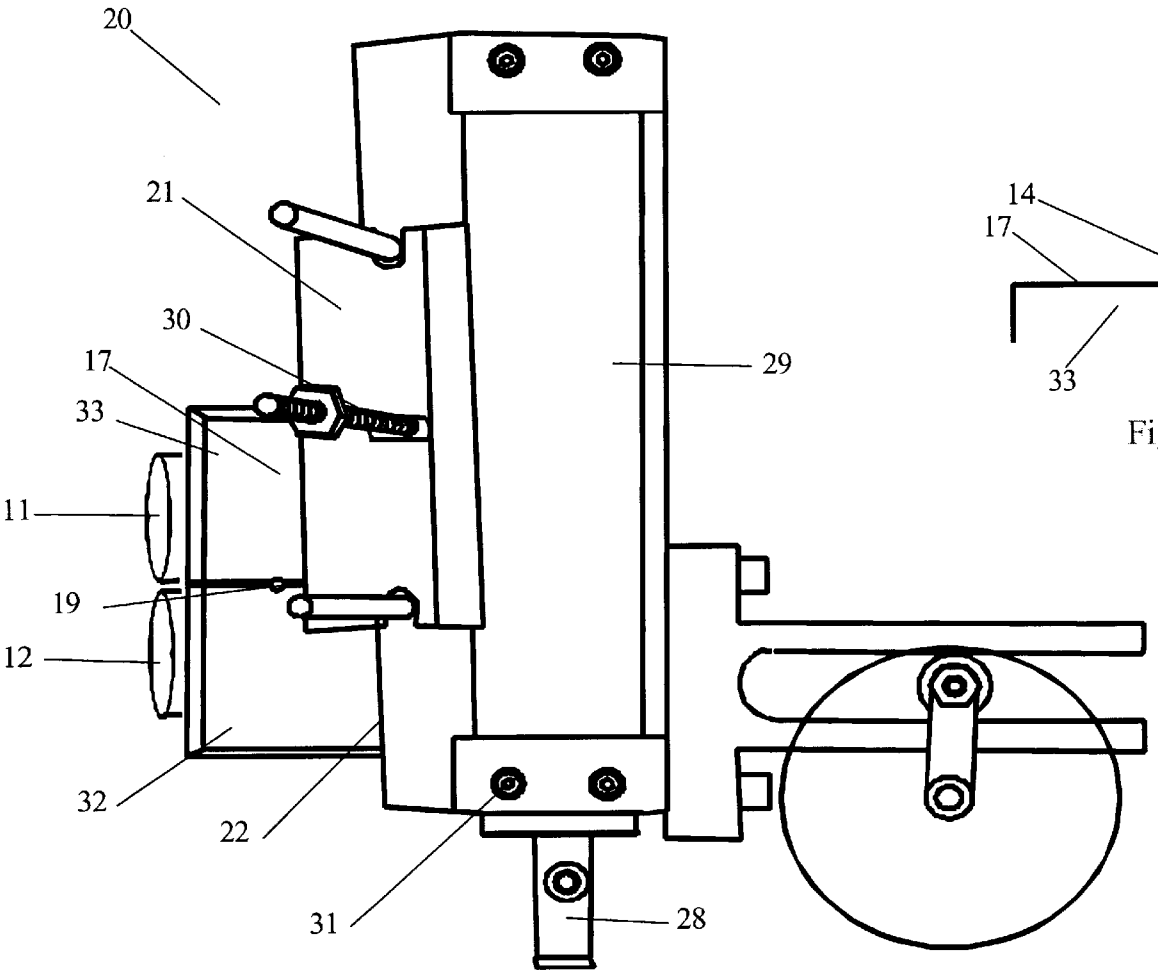
FIG. 5A shows a cable shearing system according to the current invention.

Referring to FIG. 5A, the cable cutting system (20) comprises a movable razor blade (21) and a pin-and-spring assembly (30) mounted to an alignment plate (29). The alignment plate (29) holds the blade (21) at an adjustable angle to the face (17) of the die (32, 33), thus providing for optimum cutting angle contact of the blades cutting edge with the die's (32, 33) face (17), as seen in the plan view of the cable cutting system shown in FIG. 5B. The alignment plate (29) also provides for an adjustable sawing angle, preferably no more than eight degrees from vertical—with vertical being the up and down motion of the alignment plate (29)—for shearing of the elastomer cable. This sawing action produces smooth, clean surfaces on the ends of the cable, free of defects such as damaged conductors and elastomer jacket material. This is in contrast to a blade motion that is perpendicular to the blade, that is, having a sawing angle of 90 degrees, a chopping action. Such perpendicular shearing tends to bend the elastomer cable during cutting, thus producing defects upon the edges of the button.

As shown in FIG. 5B, the blade's (21) cutting angle against the die's face (17) is preferably adjustable to up to approximately 30 degrees with spacer shims (not shown) set behind the blade. This angle is adjustable to ensure that the sharpened cutting edge of the razor blade (21) against the die's face (17) is at an optimum angle for defect free cutting.

Referring again to FIG. 5A, the blade sawing angle is adjustable in the range of two to eight degrees with mounting screws (31) that hold the alignment plate (29) to a linear slide (28). The linear slide (28) enables the cutting blade (21) to travel across the face (17) of the clamping die (32, 33). As the cutting blade (21) is drawn down, it shears the elastomer cable as it travels past the clamping hole (19). As noted, this low angle sawing action shears the button, providing a clean, flat cut to the cable surface. The razor blade's (21) cutting surface is preferably an extra-keen coated blade and cryo hardened for preservation of its sharpness, for clean cutting, and for long life.

Figure 6:
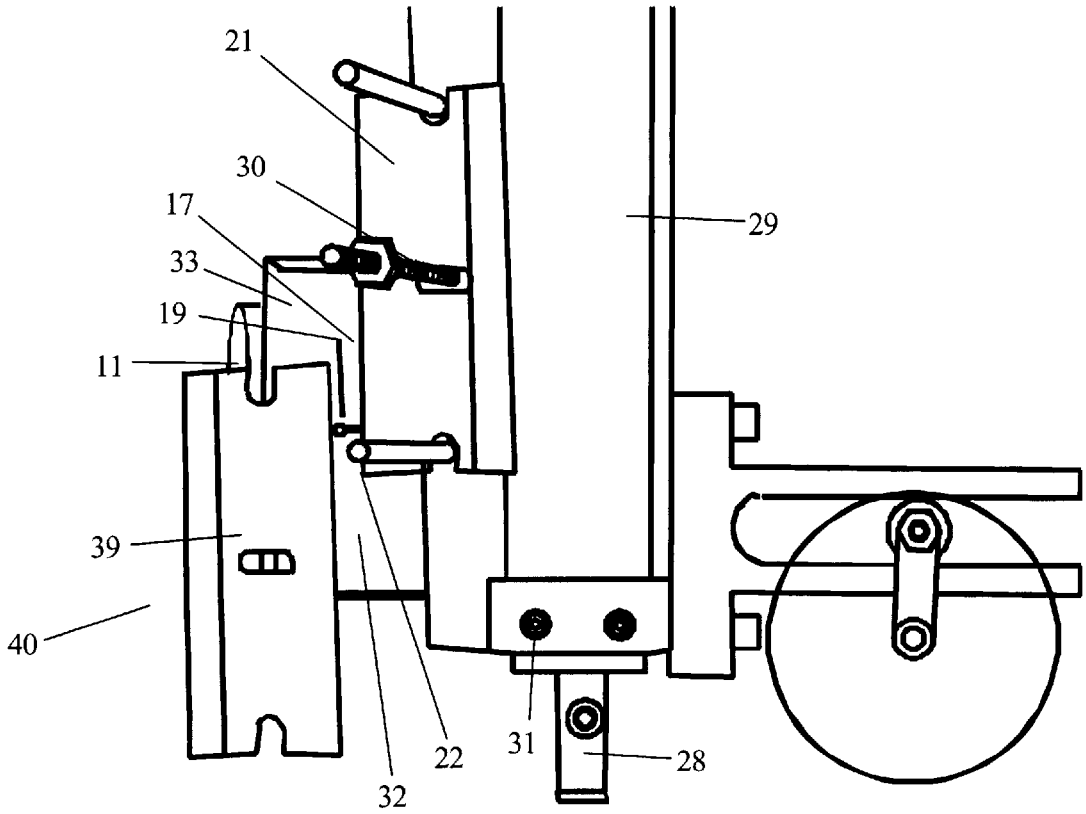
FIG. 6 shows an alternate cable shearing system according to current invention.

Referring to FIG. 6, in an alternate embodiment of the cable cutting system (40), there is a second razor blade (39), which nicks the cable on the opposite side from where the primary razor blade (21) begins cutting. Like the first blade (21) this second blade (39) is held at an adjustable sawing angle, again, preferably no more than eight degrees, for nicking of the elastomer cable. This nicking action takes place prior to the cutting by the primary blade (21), and serves to prevent a possible tear in the elastomer sheath at the nick point when the primary razor blade finishes cutting through the cable.

Referring again to FIG. 1, in the manual embodiment, there is a slotted actuator arm (2) attached to the alignment plate (29) that transfers motion from the hand crank roller bearing (3). Turning the hand crank (4) in either direction activates the cutting action. Additionally, the manual advancement system controls all three major activities of the cutter: cable advancement, cable clamping and cable cutting. Thus, all three major systems are actuated by turning the hand crank (4) in either direction, clockwise or counter clockwise.

In a motorized embodiment of the invention, the hand crank is replaced with a gear reduction and stepper motor drive. Further, the cable is automatically unwound from the supply spool by a set of rollers driven through a belt by the stepper motor. The cable passes through an idler arm that senses available slack in the cable as the cable is fed into the cutter. Preferably, positioned between the unspooler and the cutting rollers there is an additional set of three rollers and an idler arm that senses available slack in the cable. The purpose of this section, called the zero load feed section, is to ensure that there is no back pressure or load on the cable from the unspooler section that would pull the cable from the die as it is being cut.

B. Cutter Operation

In the manual embodiment, operation of the invented apparatus begins with the cutting assembly in the bottom position, the cable clamp closed and the cable advancement rollers stopped. As the hand crank is turned, a roller bearing in a slotted actuator arm begins to raise the cable-cutting assembly and mounted razor blade. The cutting assembly motion activates the die opening of the clamping assembly and the feed rollers of the advancement assembly. Once the razor blade clears the feed hole of the cable clamp assembly, the upper clamp die is raised by a screw adjustment against a pin on the cutter assembly. This causes the clamping die to open and release the cable for advancement. Once the dies are open, the continued turning of the hand crank towards the top of the cutter assembly stroke causes the actuator arm to make contact with the cable advancement mechanism's roller clutch arm. As the cutter assembly finishes its upstroke it presses against the cable advancement clutch arm, turning the cable advancement rollers and feeding the cable so that, preferably, 0.040 inches, extends from the face of the clamp die. As the cutter assembly starts down it releases the cable clamp assembly so the die closes and clamps the cable for cutting. Continuing to turn the handle causes the cable cutter assembly to finish its down stroke, shearing the button from the face of the die. Continuing to turn the handle still further repeats the cycle and another button is cut.

One embodiment of the invented apparatus comprises a fully motorized system with cable spool unwinder and zero load feed section. Such embodiment uses substantially the same method of operation as the manual embodiment, but incorporates: air jets to clean the die clamping area; a cable guide between the rollers and the die; and separate stepper motors for automatic operation of the cable unspooler system, the zero load feed section and the cable clamping and cutting section.

Although the present invention is described in reference to the electronics industry, it will be appreciated by those skilled in the art that the invention is not limited to that field. Rather, the invention is useful in any art field requiring imbedded elastomer cables that require precision cutting and clean separations.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention. It should be clear to those skilled in the art that further embodiments of the present invention may be made by those skilled in the art without departing from the teachings of the present invention.

What is claimed is:

1. A device for cutting an elastomer cable into a precise length segment with a clean surface cut comprising:

a) a cable advancement system comprising at least two cable feed rollers having a groove which engages the elastomer cable such that a precise length of the elastomer cable is metered out, the groove having a diameter substantially equal to the elastomer cable;

b) a cable clamping system comprising a pair of clamping dies, capable of clamping the elastomer cable in a fixed position, having a shearing face, wherein each clamping die has a portion cut out thus forming a clamping hole between the pair of clamping dies; and c) a cable cutting system comprising a first movable razor blade held against the shearing face at a first blade-to-face angle, wherein the first movable razor blade slides along a linear path and shears the elastomer cable as it travels past the clamping hole at a first sawing angle;

wherein:

each cable feed roller additionally comprises a shaft; and the cable advancement system additionally comprises:

a pair of zero-backlash gears attached to each cable feed roller's shaft, wherein the pair of zero-backlash gears drive the cable feed rollers;

on at least one cable feed roller shaft, a roller clutch which causes the cable advancement system to feed the elastomer cable in only one direction; and on another cable feed roller shaft, a feed clutch, having an arm, which advances the at least two cable feed rollers during cable feed and slips during the arm's return motion.

2. The device of claim 1 wherein the first blade-to-face angle is in the range of zero to thirty degrees.

3. The device of claim 1 wherein the first sawing angle is in the range of two to eight degrees from the linear path.

4. The device of claim 1 wherein the cable cutting system additionally comprises a cutting blade linear slide which causes the first movable razor blade to move along the linear path so as to cut the elastomer cable, an alignment plate, and a pin-and-spring assembly which holds the first movable razor blade against the shearing face at the first blade-to-face angle and facilitates adjusting the first blade-to-face angle, wherein the pin-and-spring assembly is mounted to the alignment plate.

5. The device of claim 1 wherein the pair of clamping dies comprises a lower clamping die and an upper clamping die, and the cable clamping system further comprises a fixture which holds the lower clamping die in place and a die lifter arm which raises the upper clamping die.

6. The device of claim 1 wherein the clamping hole has a feeding portion for inserting the elastomer cable between the pair of clamping dies, and a clamping portion for clamping the elastomer cable for shearing.

7. The device of claim 6 wherein the feeding portion is larger than the elastomer cable and is tapered, and the clamping portion is substantially the same size as the elastomer cable and is not tapered.

8. The device of claim 1 wherein the cable cutting system further comprises a second movable razor blade held against the shearing face at a second blade-to-face angle, wherein the second movable razor blade nicks, at a second sawing angle, the elastomer cable prior to a time when the first movable razor blade shears the elastomer cable 18.

* * * * *